US010276939B1

(12) United States Patent
Webb et al.

(10) Patent No.: US 10,276,939 B1
(45) Date of Patent: Apr. 30, 2019

(54) THROUGH-THE-LID PIT ANTENNA

(71) Applicant: Mueller International, LLC, Atlanta, GA (US)

(72) Inventors: Spencer L. Webb, Windham, NH (US); Ronald Todd Bushey, Windham, NH (US); David Edwin Splitz, Sandwich, MA (US)

(73) Assignee: Mueller International, LLC, Atlanta, GA (US)

( * ) Notice: Subject to any disclaimer, the term of this patent is extended or adjusted under 35 U.S.C. 154(b) by 0 days.

(21) Appl. No.: 15/824,540

(22) Filed: Nov. 28, 2017

(51) Int. Cl.

| | |
|---|---|
| ***H01Q 1/00*** | (2006.01) |
| ***H01Q 9/04*** | (2006.01) |
| ***H01Q 1/04*** | (2006.01) |
| ***H01Q 1/24*** | (2006.01) |
| ***H01Q 9/32*** | (2006.01) |
| ***H01Q 1/22*** | (2006.01) |

(52) U.S. Cl.
CPC ..... *H01Q 9/0464* (2013.01); *H01Q 1/002* (2013.01); *H01Q 1/04* (2013.01); *H01Q 1/2233* (2013.01); *H01Q 1/241* (2013.01); *H01Q 9/32* (2013.01)

(58) Field of Classification Search
CPC .. H01Q 1/04; H01Q 1/22; H01Q 1/38; H01Q 1/42; H01Q 1/233; H01Q 7/00; G01D 4/002
USPC ..... 340/870.02, 870.01, 870.03; 343/702, 343/895, 700 MS, 719, 872, 769
See application file for complete search history.

(56) References Cited

U.S. PATENT DOCUMENTS

| | | | |
|---|---|---|---|
| 4,661,992 | A | 4/1987 | Garay |
| 4,740,794 | A | 4/1988 | Phillips |
| 5,181,043 | A | 1/1993 | Cooper |
| 5,298,894 | A | 3/1994 | Cerny |
| 5,557,287 | A | 9/1996 | Pottala |
| 5,617,084 | A | 4/1997 | Sears |
| 5,659,300 | A | 8/1997 | Dresselhuys |
| 5,825,303 | A | 10/1998 | Bloss |
| 5,877,703 | A | 3/1999 | Bloss et al. |
| 6,177,883 | B1 | 1/2001 | Jennetti |
| 6,218,995 | B1 | 4/2001 | Higgins |
| 6,300,907 | B1 | 10/2001 | Lazar et al. |
| 6,304,227 | B1 | 10/2001 | Hill et al. |
| 6,369,769 | B1 | 4/2002 | Nap |
| 6,378,817 | B1 | 4/2002 | Bublitz |
| 6,414,605 | B1 | 7/2002 | Walden |
| 6,556,812 | B1 | 4/2003 | Pennanen |
| 6,606,070 | B2 | 8/2003 | Olson et al. |
| 6,617,976 | B2 | 9/2003 | Walden |
| 6,657,552 | B2 | 12/2003 | Belski et al. |
| 6,819,292 | B2 | 11/2004 | Winter |

(Continued)

*Primary Examiner* — Lam T Mai
(74) *Attorney, Agent, or Firm* — Taylor English Duma LLP

(57) ABSTRACT

A pit antenna assembly includes a node, the node including an antenna, the antenna configured to radiate radio waves; an inner tube defining a first inner tube end and a second inner tube end, the first inner tube end disposed opposite from the second inner tube end, the inner tube defining an inner tube bore extending through the inner tube from the first inner tube end to the second inner tube end, the antenna received within the inner tube bore through the first inner tube end, the inner tube configured to electromagnetically couple energy from the antenna; and a top disc, the top disc connected to the second inner tube end of the inner tube, the top disc configured to radiate the energy from the antenna.

21 Claims, 11 Drawing Sheets

(56) References Cited

U.S. PATENT DOCUMENTS 6,954,144 B1 10/2005 Kiser et al.
7,065,350 B2 6/2006 Capobianco
7,202,828 B2 4/2007 Zehngut et al.
7,221,286 B2 5/2007 Gould
7,283,063 B2 10/2007 Salser, Jr.
7,365,687 B2 4/2008 Borleske et al.
7,429,953 B2 9/2008 Buris
7,446,672 B2 11/2008 Johnson
7,453,373 B2 11/2008 Cumeralto et al.
7,492,267 B2 * 2/2009 Bilyeu ..... G06K 17/00 340/568.1
7,498,953 B2 * 3/2009 Salser, Jr. ..... H04Q 9/00 340/636.1
7,508,318 B2 3/2009 Casella et al.
7,510,422 B2 3/2009 Showcatally et al.
7,554,460 B2 6/2009 Verkleeren
7,701,199 B2 4/2010 Makinson
7,746,246 B2 6/2010 Salser
8,264,415 B2 9/2012 Winkler et al.
8,378,847 B2 2/2013 Bartram et al.
8,462,062 B2 6/2013 Westrick
2008/0150750 A1 * 6/2008 Parris ..... G01D 4/002 340/870.02
2008/0272981 A1 11/2008 Gagne et al.
2010/0026515 A1 2/2010 Lazar
2010/0182162 A1 7/2010 Winkler et al.
2010/0253538 A1 * 10/2010 Smith ..... G01D 4/002 340/870.02
2011/0029655 A1 * 2/2011 Forbes, Jr. ..... G06Q 10/00 709/223
2011/0063124 A1 3/2011 Bartram
2012/0287596 A1 * 11/2012 Manion ..... G01D 4/002 361/816
2014/0055283 A1 * 2/2014 Ching ..... H04Q 9/00 340/870.02
2017/0162930 A1 * 6/2017 Christiansen ..... H01Q 1/2233

* cited by examiner

THROUGH-THE-LID PIT ANTENNA

TECHNICAL FIELD

This disclosure relates to antennas. More specifically, this disclosure relates to a pit antenna for a pit assembly.

BACKGROUND

Pit vaults are often buried to enclose and protect equipment and components of underground pipe infrastructure systems, such as water distribution systems. For example, water meters, such as at a house or building, are often enclosed within pit vaults, and the water meters can record water consumption for the house or building. In the past, meter readers manually opened each pit vault to read the water meter. More recently, some water meters can be attached to nodes which can wirelessly transmit water consumption data. The data can be wirelessly received and recorded in order to bill the house or building for the appropriate water usage.

The node and an antenna of the node can also be housed within the pit vault to protect the node and antenna from damage, such as by being stepped upon or run over with a lawn mower. Pit vaults and lids of the pit vaults, which are often made from ferrous metal, can limit the range and efficiency of wireless transmission from the nodes by interfering with the wireless signals transmitted by the node. The antenna can be placed external to the pit vault and the lid; however, the antenna can be vulnerable to physical damage and prevent a tripping hazard when disposed external to the pit vault and the lid. Additionally, expensive waterproof connectors must typically be used to connect the antenna to the node to prevent water intrusion which can cause electrical failures, such as short circuiting.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a pit antenna assembly comprising a node, the node comprising an antenna, the antenna configured to radiate radio waves; an inner tube defining a first inner tube end and a second inner tube end, the first inner tube end disposed opposite from the second inner tube end, the inner tube defining an inner tube bore extending through the inner tube from the first inner tube end to the second inner tube end, the antenna received within the inner tube bore through the first inner tube end, the inner tube configured to electromagnetically couple energy from the antenna; and a top disc, the top disc connected to the second inner tube end of the inner tube, the top disc configured to radiate the energy from the antenna.

Also disclosed is a pit assembly comprising a pit vault defining a top end and a bottom end, a vault cavity defined within the pit vault, a vault opening of the vault cavity defined at the top end; a lid shaped and sized complimentary to the vault opening, the lid defining a top surface and a bottom surface, a lid opening defined extending through the lid from the top surface to the bottom surface, the lid covering the vault opening and at least partially enclosing the vault cavity; and a pit antenna comprising an antenna assembly defining a disc shape and positioned atop the top surface of the lid; and a coupling assembly attached to the antenna assembly, the coupling assembly defining a tubular shape, the coupling assembly extending downwards from the antenna assembly, the coupling assembly extending through the lid opening and into the vault cavity, the coupling assembly defining an inner tube bore configured to receive an antenna.

Also disclosed is a method of coupling a pit antenna to a node, the method comprising inserting a node antenna of the node into an inner tube bore of the pit antenna, a coupling assembly of the pit antenna comprising an inner tube, the inner tube bore defined by the inner tube, the node and the coupling assembly positioned within a vault cavity defined by a pit vault; passively receiving radio-frequency energy from the node antenna with the coupling assembly of the pit antenna; and passively radiating the radio-frequency energy as radio waves outside of the pit vault from an antenna assembly of the pit antenna, the radio waves carrying a signal, the antenna assembly electrically connected to the coupling assembly, the antenna assembly disposed external to the pit vault.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
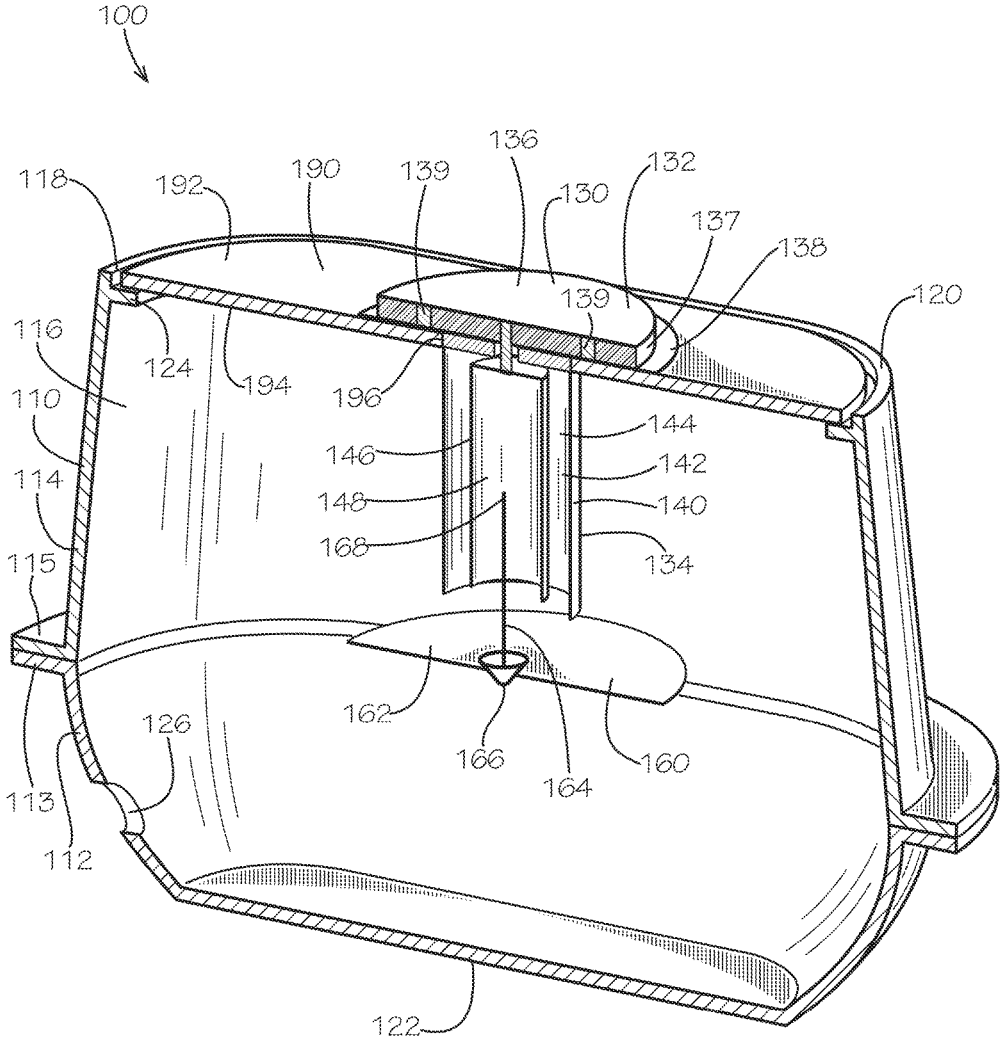
FIG. 1 is a perspective cross-sectional view of a pit assembly comprising a pit vault, a lid, and a pit antenna in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a pit assembly and associated methods, systems, devices, and various apparatus. The pit assembly can comprise a pit antenna, a pit vault, and a lid. It would be understood by one of skill in the art that the disclosed wide range coupling is described in but a few exemplary embodiments among many. No particular terminology or description should be considered limiting on the disclosure or the scope of any claims issuing therefrom.

FIG. 1 is a perspective cross-sectional view of a pit assembly 100 comprising a pit vault 110, a lid 190, and a pit antenna 130 in accordance with one aspect of the present disclosure. In the present aspect, the pit vault 110 and the lid 190 can be standard components commonly used in the water infrastructure industry; however, in other aspects, either or both of the pit vault 110 and the lid 190 can be proprietary components which can differ from industry standard pit vaults 110 and lids 190 in design, shape, and/or size. The pit vault 110 can comprise a top shell 114 and a bottom shell 112. The top shell 114 can define a top flange 115, and the bottom shell 112 can define a bottom flange 113. The top flange 115 can be attached to the bottom flange 113 to secure the top shell 114 to the bottom shell 112.

The pit vault 110 can define a top end 120 and a bottom end 122, and the top end 120 can be disposed opposite from the bottom end 122. The top end 120 can be defined by the top shell 114, and the bottom end 122 can be defined by the bottom shell 112. A vault cavity 116 can be defined within the pit vault 110, and a vault opening 118 of the vault cavity 116 can be defined at the top end 120. A vault shelf 124 can extend inwards into the vault cavity 116 from the top shell 114. The pit vault 110 can additionally define one or more vault bores, such as vault bore 126. The vault bores can be defined extending through either the bottom shell 112, as shown, or the top shell 114. The vaults bores can provided access for inlet lines and outlet lines which can extend into the vault cavity 116. For example and without limitation, the vault bore 126 can provide access for an inlet line or outlet line, such as a pipe, hose, or tube, to pass through the bottom shell 112 and connect to equipment (not shown), such as a water meter or any other suitable piece of equipment, which can be housed within the vault cavity 116.

The lid 190 can be shaped and sized complimentary to the vault opening 118, and the lid 190 can rest on the vault shelf 124 to cover the vault opening 118 and at least partially enclose the vault cavity 116. In the present aspect, the vault shelf 124 can be recessed from the top end 120, and a top surface 192 defined by the lid 190 can be positioned substantially flush with the top end 120 of the pit vault 110. In other aspects, the top surface 192 can sit above the top end 120 or can be recessed below the top end 120 of the pit vault 110.

The lid 190 can define a lid opening 196 extending through the lid from the top surface 192 to a bottom surface 194 defined by the lid 190 opposite from the top surface 192. In the aspect of the lid 190 commonly used within the water infrastructure industry, the lid opening 196 can be a 1.75" diameter hole, which is considered an industry standard; however, in other aspects, the lid opening 196 can define a diameter larger or smaller than 1.75". The pit assembly 100 can commonly be installed underground so that the lid 190 can be positioned approximately flush with a surrounding ground level. In various other aspects, the lid 190 can be positioned either above the surrounding ground level or below the surrounding ground level. The pit antenna 130 can be a through-the-lid ("TTL") antenna configured to mount to the lid 190 through the lid opening 196.

The pit antenna 130 can comprise an antenna assembly 132 and a coupling assembly 134. The antenna assembly 132 can define a disc shape, and the antenna assembly 132 can be positioned atop the top surface 192 of the lid 190. The antenna assembly 132 can comprise a top disc 136, a disc spacer 137, and a bottom disc 138. The disc spacer 137 can be positioned between the top disc 136 and the bottom disc 138, and the disc spacer 137 can be in facing engagement with each of the top disc 136 and the bottom disc 138.

The top disc 136 can be attached to the bottom disc 138 by at least one standoff 139. In the present aspect, the pit antenna 130 can comprise four standoffs 139 (two standoffs not shown) which can be equally distributed in a circular pattern around the antenna assembly 132. In other aspects, the pit antenna 130 can comprise greater or fewer than four standoffs 139. Each standoff 139 can extend through the disc spacer 137, and the top disc 136, the standoffs 139, and the bottom disc 138 can be connected in electrical communication. In various aspects, the quantity of standoffs 139 and the placement of the standoffs 139 relative to the coupling assembly 134 can be manipulated and optimized as a method for impedance-matching the antenna assembly 132 to the coupling assembly 134, as further described below with respect to FIGS. 9, 10, and 17. The standoffs 139 can also provide structural strength to the antenna assembly 132 of the pit antenna 130. In the present aspect, the bottom disc 138 can be positioned adjacent to the top surface 192 of the lid 190. In some aspects, bottom disc 138 can be in facing engagement with the top surface 192 of the lid 190; however, in other aspects, the bottom disc 138 may not contact the top surface 192.

The coupling assembly 134 can be attached to the antenna assembly 132, and the coupling assembly 134 can extend downwards from the antenna assembly 132 through the lid opening 196 and into the vault cavity 116. The coupling assembly 134 can comprise an inner tube 146 and an outer tube 140. The inner tube 146 can define an inner tube bore 148, and the outer tube 140 can define an outer tube bore 142. The inner tube 146 can extend into the outer tube bore 142, and in the present aspect, the inner tube 146 can be coaxial with the outer tube 140. A portion of the outer tube bore 142 defined between the inner tube 146 and the outer tube 140 can define a coupling annulus 144. In the present aspect, the coupling annulus 144 can be open; however in other aspects, the coupling annulus 144 can be completely or partially filled by a dielectric insulation material. In some aspects, the dielectric insulation material can be formed as a sleeve (not shown) which can be inserted and withdrawn from the coupling annulus 144. In other aspects, the dielectric insulation material can be bonded to one or both of the inner tube 146 and the outer tube 140.

Figure 2:
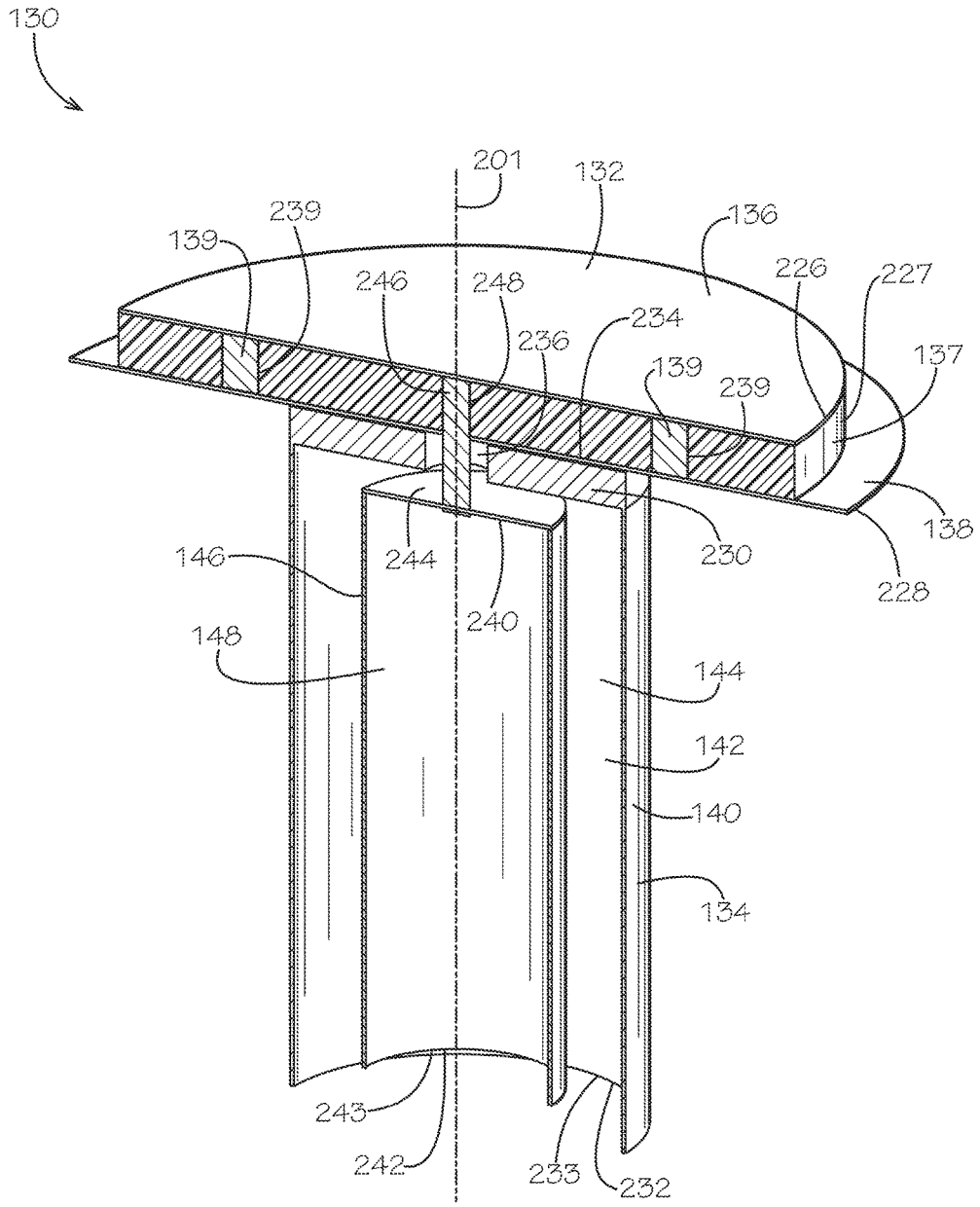
FIG. 2 is a perspective cross-sectional view of the pit antenna of FIG. 1.

The inner tube 146 can be attached to the top disc 136, and the inner tube 146 can be connected in electrical communication with the top disc 136, as further described with respect to FIG. 2. The outer tube 140 can be attached to the bottom disc 138, and the outer tube 140 can be connected in electrical communication with the bottom disc 138. The inner tube 146, the top disc 136, the standoffs 139, the bottom disc 138, and the outer tube 140 can each comprise an electrically conductive material, such as copper, iron, steel, stainless steel, brass, aluminum, bronze, or any other suitable material. The disc spacer 137 can comprise a dielectric insulation material. The material selections can provide an electrical pathway from the inner tube 146 to the top disc 136, through the top disc 136 to the standoffs 139, through the standoffs 139 to the bottom disc 138, and through the bottom disc 138 to the outer tube 140 which can define an antenna circuit of the pit antenna 130. The inner tube 146 and the outer tube 140 can act as opposite poles of the antenna circuit.

In the aspect shown, the pit assembly 100 can further comprise an exemplary node antenna 160 disposed within the vault cavity 116. In the present aspect, the node antenna 160 can comprise an antenna wire 164 which can define a first end 168 and a second end 166. In the present aspect, the antenna wire 164 can be a monopole antenna, such as a quarter-wavelength monopole antenna, and the antenna wire 164 can radiate radio-frequency energy as radio waves. The second end 166 of the antenna wire 164 can be attached to a ground plane 162 which can be oriented substantially perpendicular to the antenna wire 164.

In the present aspect, the node antenna 160 is provided only as a schematic representation and should not be viewed as limiting. The node antenna 160 can be comprised by a common node (not shown) which can be similar to a node 350 shown in FIG. 3. The common node can be configured to transmit a signal through the node antenna 160 which can radiate the radio waves that carry the signal. As an example of but one usage, the common node can be attached to a water meter (not shown), and the common node can transmit the signal carrying water consumption data which can be wirelessly received by a meter reader (not shown).

The pit antenna 130 can be configured to wirelessly and passively couple with the node antenna 160. In the present aspect, the first end 168 of the antenna wire 164 can be positioned within the inner tube bore 148 of the inner tube 146 of the coupling assembly 134. The inner tube 146 can electromagnetically couple with the antenna wire 164 so that the inner tube 146 receives the radio-frequency energy from the antenna wire 164. The outer tube 140 can also electromagnetically couple with the antenna wire 164 to gather and receive any radio-frequency energy which is not received by the inner tube 146, such as radio-frequency energy released and reflected within the vault cavity 116 of the pit vault 110. The outer tube 140 can also shield the inner tube 146 from electromagnetic interference within the vault cavity 116 to improve the accuracy of the signal received by the inner tube 146 from the node antenna 160. The inner tube 146 and the outer tube 140 can each wirelessly electromagnetically couple with the node antenna 160 without an electrical connection between the pit antenna 130 and the node antenna 160. Once coupled, the radio-frequency energy received by the coupling assembly 134 can be conducted to the antenna assembly 132 of the pit antenna 130, and the radio-frequency energy can be radiated as radio waves by the antenna assembly 132 external to the vault cavity 116.

In the present aspect, the pit antenna 130 can be a passive device wherein the pit antenna 130 does not comprise a power source or logic circuitry, and the pit antenna 130 can be electrically isolated from the node antenna 160 by an air gap which prevents electrical conduction between the node antenna 160 and the pit antenna 130. In the present aspect, no electrical current is conducted from the node antenna 160 to the pit antenna 130. The passive nature of the pit antenna 130 can be desirable to provide for a rugged and cost efficient device capable of electromagnetically coupling with the common node (not shown) located within the vault cavity 116 and radiating the signal external to the pit vault 110. By remaining electrically isolated from the node antenna 160, the pit antenna 130 does not require an electrical connector which can be expensive as well as vulnerable to failure, such as by water intrusion. Because the pit antenna 130 does not utilize a power source, such as a battery, the pit antenna 130 can function indefinitely without maintenance.

When the signal is transmitted from the node antenna 160 without the pit antenna 130 installed on the lid 190, the pit vault 110 and the lid 190 can act as a Faraday cage which can interfere with transmission between the node antenna 160 within the vault cavity 116 and a receiver, such as a meter reader, positioned external to the vault cavity 116. The majority of the radio-frequency energy can be reflected within the vault cavity 116 by the pit vault 110 and the lid 190, thereby greatly reducing the strength and transmission range of the signal outside of the pit assembly 100. Quarter-wave monopole antennas, such as the node antenna 160, can demonstrate annular radiation patterns emitted along a length of the antenna wire 164, and a null in the radiation pattern can be positioned above the first end 168 of the antenna wire 164. Therefore, few radio waves pass directly through the lid opening 196 without first reflecting within the vault cavity 116, even when the antenna wire 164 is aligned with the lid opening 196. Uncontrolled reflection within the vault cavity 116 can result in interference in the signal and decreased total transmission efficiency.

In the present aspect, the pit antenna 130 can be optimized for transmission within the 902 to 928 MHz Industrial, Scientific, and Medical ("ISM") radio band. In other aspects, the pit antenna 130 can be optimized for transmission in other radio frequency bands. During development of the pit antenna 130, computer modeling was conducted for transmission of signals at frequencies of 902 MHz, 915 MHz, and 928 MHz for the pit vault 110, both with and without the pit antenna 130 mounted to the lid 190. For the purposes of modeling, the pit vault 110 and the lid 190 were modeled as cast iron components with a 0.05" gap between the lid 190 and the pit vault 110. The lid opening 196 was modeled as an industry standard 1.75" diameter hole. Signal strength was measured external to the pit vault 110, and total transmission efficiency was calculated based on loss of signal strength. Without the pit antenna 130 installed on the lid 190, total transmission efficiency for the pit vault 110 measured −20.87 dB at 902 MHz, −22.34 dB at 915 MHz, and −24.61 dB at 928 MHz. With the pit antenna 130 mounted through the lid opening 196 of the lid 190 and coupled to the node antenna 160, total transmission efficiency for the pit vault 110 measured −3.16 dB at 902 MHz, −2.18 dB at 915 MHz, and −2.00 dB at 928 MHz. The models demonstrated an average 20.16 dB total transmission efficiency improvement across these three sample frequencies with the pit antenna 130 installed on the lid 190 of the pit vault 110 and wirelessly coupled to the node antenna 160.

The common node (not shown) can often be battery powered with a finite energy supply. The inefficiency of the pit vault 110 without the pit antenna 130 in place can limit transmission distances without incurring excessive power consumption. With the pit antenna 130 in place and wirelessly coupled to the node antenna 160, transmission distances can be increased while also reducing power consumption compared to aspects of the pit vault 110 not comprising the pit antenna 130.

Increased transmission distances can be desirable to simplify meter reading operations. For example in some locations, vehicles equipped to receive signals from a series of pit vaults 110, such as in a residential neighborhood, can drive by the pit vaults 110 to wirelessly read water meters contained with the respective pit vaults 110. With pit vaults 110 limited to relatively short transmission distances, the vehicles can be required to drive up and down each street to read all of the water meters of the pit vaults 110 located on that street. With pit vaults 110 demonstrating greater transmission range, the vehicle can read all of the meters of the pit vaults 110 by driving by the neighborhood on a main road without requiring the vehicle to pull into the neighborhood. In other aspects, the pit vaults 110 demonstrating greater transmission ranges could communicate with ground-based hubs which can collect signals in real time from meters within pit vaults 110 distributed over a geographic region. The hub can re-transmit data from the signals to a billing center, such as by satellite communication or through internet communication, which can eliminate the costs of mobile, ground-based meter reading vehicles and personnel for the geographic region.

FIG. 2 is a perspective cross-sectional view of the pit antenna 130 of FIG. 1. In the present aspect, the inner tube 146 can define a first inner tube end 243 and a second inner tube end 244. The first inner tube end 243 can be disposed opposite from the second inner tube end 244. The inner tube bore 148 can extend inwards into the inner tube 146 from the first inner tube end 243 to the second inner tube end 244. The first inner tube end 243 can define a first inner tube opening 242 of the inner tube bore 148, and the second inner tube end 244 can define an inner end cap 240. In the present aspect, the inner end cap 240 can fully enclose the second inner tube end 244; however in other aspects, the inner end cap 240 can partially enclose the second inner tube end 244.

The outer tube 140 can define a first outer tube end 233 and a second outer tube end 234. The first outer tube end 233 can be disposed opposite from the second outer tube end 234. The outer tube bore 142 can extend inwards into the outer tube 140 from the first outer tube end 233 to the second outer tube end 234. The first outer tube end 233 can define a first outer tube opening 232 of the outer tube bore 142, and the second outer tube end 234 can define an outer end cap 230. A connector bore 236 can be defined extending through the outer end cap 230, and the outer end cap 230 can partially enclose the second outer tube end 234. The outer end cap 230 can be attached to the bottom disc 138 by a technique such as welding, brazing, soldering, bonding with an electrically conductive adhesive, or any other suitable technique. In other aspects, the outer tube 140 and the bottom disc 138 can be integrally formed, such as by casting or machining from stock material, for example and without limitation.

In the present aspect, the second inner tube end 244 of the inner tube 146 can be attached to the top disc 136 by a connector 246. In the present aspect, the connector 246 can be rigid, and the connector 246 can comprise an electrically conductive material, such as a metal rod, for example and without limitation. In other aspects, the connector 246 can be flexible, and the connector 246 can comprise an electrically conductive wire, cable, or other suitable material. The connector 246 can be attached to each of the inner tube 146 and the top disc 136 by a technique such as welding, brazing, soldering, bonding with an electrically conductive adhesive, or any other suitable technique. The connector 246 can extend through the connector bore 236 of the outer end cap 230 and through a connector bore 248 defined by the disc spacer 137.

As shown, the standoffs 139 can each extend through a respective standoff bore 239 defined by the disc spacer 137. The standoffs 139 can be attached to each of the top disc 136 and the bottom disc 138 by a technique such as welding, brazing, soldering, bonding with an electrically conductive adhesive, or any other suitable technique. In other aspects, the standoffs 139 can be electrically conductive fasteners, such as screws, bolts, or rivets which can mechanically attach the top disc 136 to the bottom disc 138.

In the present aspect, each of the top disc 136, the disc spacer 137, and the bottom disc 138 can define a circular disc shape; however in other aspects, any or all of the top disc 136, the disc spacer 137, and the bottom disc 138 can define a different shape, such as triangular, rectangular, or any other suitable shape. The inner tube bore 148 can define an axis 201, and each of the top disc 136, the disc spacer 137, the bottom disc 138, the connector 246, the connector bores 236, 248, and the outer tube 140 can be coaxial with the axis 201.

The top disc 136 can define an outer top disc surface 226 extending around a circumference of the top disc 136. The disc spacer 137 can define an outer spacer surface 227 extending around a circumference of the disc spacer 137. The bottom disc 138 can define an outer bottom disc surface 228 extending around a circumference of the bottom disc 138. In the present aspect, the top disc 136 and the disc spacer 137 can be substantially equal in diameter; however, in other aspects, the top disc 136 can be larger or smaller than the disc spacer 137 in diameter. The bottom disc 138 can be larger in diameter than the top disc 136.

The bottom disc 138 and the lid 190 (shown in FIG. 1) can together act as a ground plane for the radio waves which are radiated from the antenna assembly 132. The antenna assembly 132 can be a disc antenna which demonstrates radiation patterns similar to those of a vertically oriented quarter-wave monopole antenna. The disc antenna and the ground plane can direct radio waves outward in an annular pattern with a null directly over the disc antenna. This radiation pattern can be desirable for short-range communications because radiated energy is not dissipated upwards towards space. Instead, the radiation pattern is concentrated outwards along the surface of the earth where the radio waves can be received by ground-based antennas, such as an antenna of a meter reader (not shown).

Figure 3:
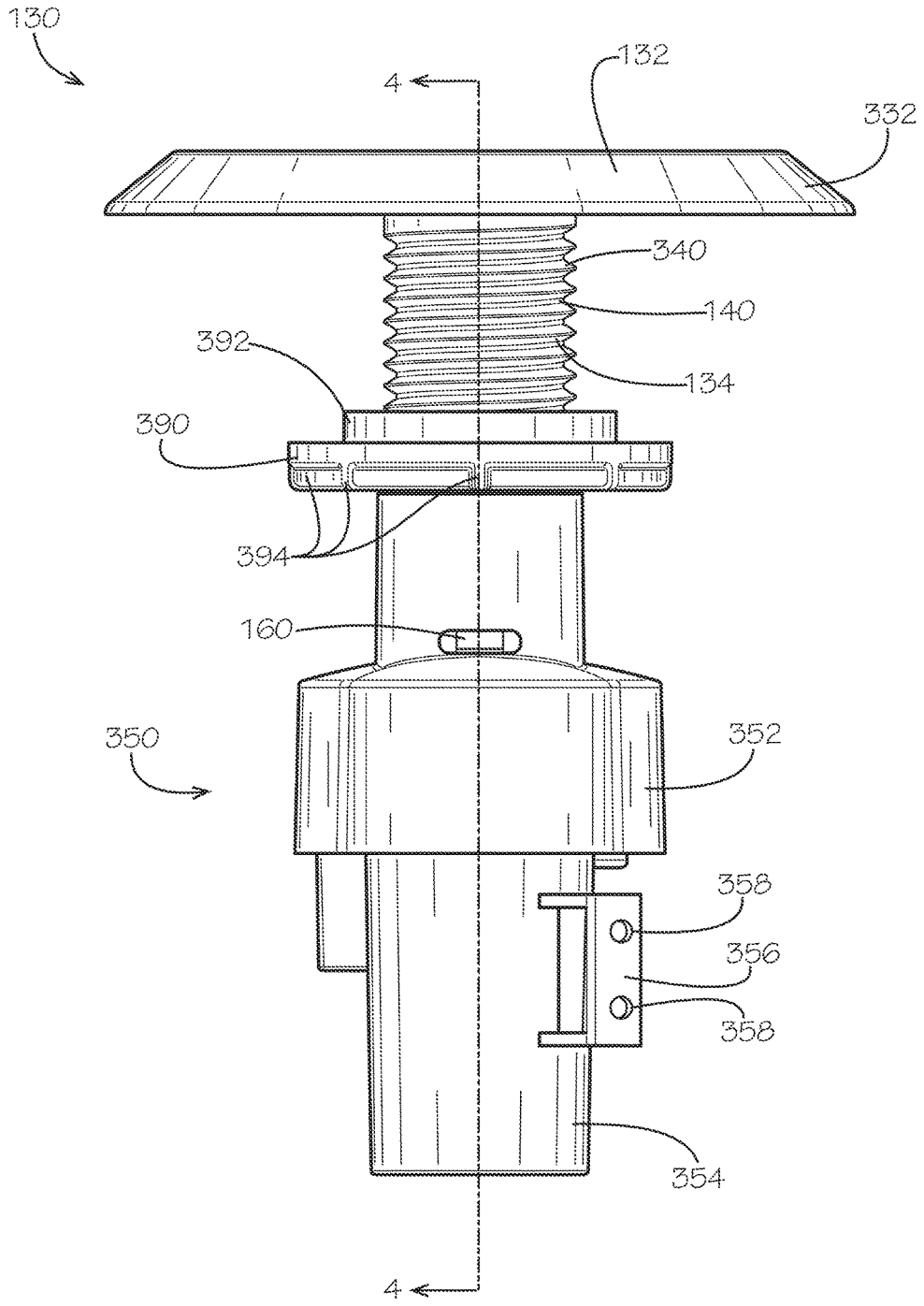
FIG. 3 is a side view of another aspect of a pit antenna and a node in accordance with another aspect of the present disclosure.

FIG. 3 is a side view of another aspect of a pit antenna 130 and the node 350 in accordance with another aspect of the present disclosure. In the present aspect, the pit antenna 130 can comprise a cover 332, a nut 390, and a gasket 392. The node 350 can be attached to the coupling assembly 134 of the pit antenna 130, opposite from the antenna assembly 132. The node 350 can comprise a top cover 352 and a bottom cover 354. In the present aspect, the bottom cover 354 can comprise a mounting bracket 356 which can define mounting holes 358. The mounting bracket 356 can be configured to mount the node 350 on equipment, such as a water meter (not shown), or to mount the node to a portion of the pit vault 110. The node 350 can further comprise another aspect of the node antenna 160 which can be received within the coupling assembly 134 of the pit antenna 130. The node antenna 160 can be attached to the top cover 352. In the present aspect, the node antenna 160 can be integrally formed with the top cover 352; however in other aspects, the node antenna 160 may not be integrally formed and can instead be attached, such as with an adhesive, a fastener, threading, or any other suitable attachment mechanism.

In the present aspect, the outer tube 140 of the coupling assembly 134 can define external threading 340. The nut 390 can be positioned on the outer tube 140 between the node 350 and the antenna assembly 132, and the nut 390 can engage the external threading 340 of the outer tube 140. In the present aspect, the nut 390 can be a finger nut configured to be hand tightened. The nut 390 can define shoulders 394 positioned circumferentially around the nut 390 which can extend radially outward from the nut 390. The shoulders 394 can aid a user in gripping the nut 390 in order to hand tighten the nut 390.

The gasket 392 can be positioned on the outer tube 140 between the nut 390 and the antenna assembly 132. In the present aspect, the gasket 392 can be an O-ring defining a square or rectangular cross-sectional profile. In other aspects, the gasket 392 can be an O-ring defining a round cross-sectional profile. In other aspects, the gasket 392 can be a different type of gasket.

During installation, the coupling assembly 134 of the pit antenna 130 can be slipped through the lid opening 196 (shown in FIG. 1) from the top surface 192 (shown in FIG. 1) towards the bottom surface 194 (shown in FIG. 1) before positioning the gasket 392 and the nut 390 on the outer tube 140 and attaching the node 350 to the coupling assembly 134. With the antenna assembly 132 positioned adjacent to the top surface 192 of the lid 190 (shown in FIG. 1), the nut 390 can then be rotated to compress the gasket 392 between the nut 390 and the bottom surface 194 of the lid 190, thereby forming a seal between the gasket 392 and the lid 190. In some aspects, the gasket 392 can be positioned between the pit antenna 130 and the top surface 192 of the lid 190. The cover 332 can be positioned over the antenna assembly 132 of the pit antenna 130, and the cover 332 and the top surface 192 can enclose the top disc 136, the disc spacer 137, and the bottom disc 138, as further described with respect to FIG. 4 below.

Figure 4:
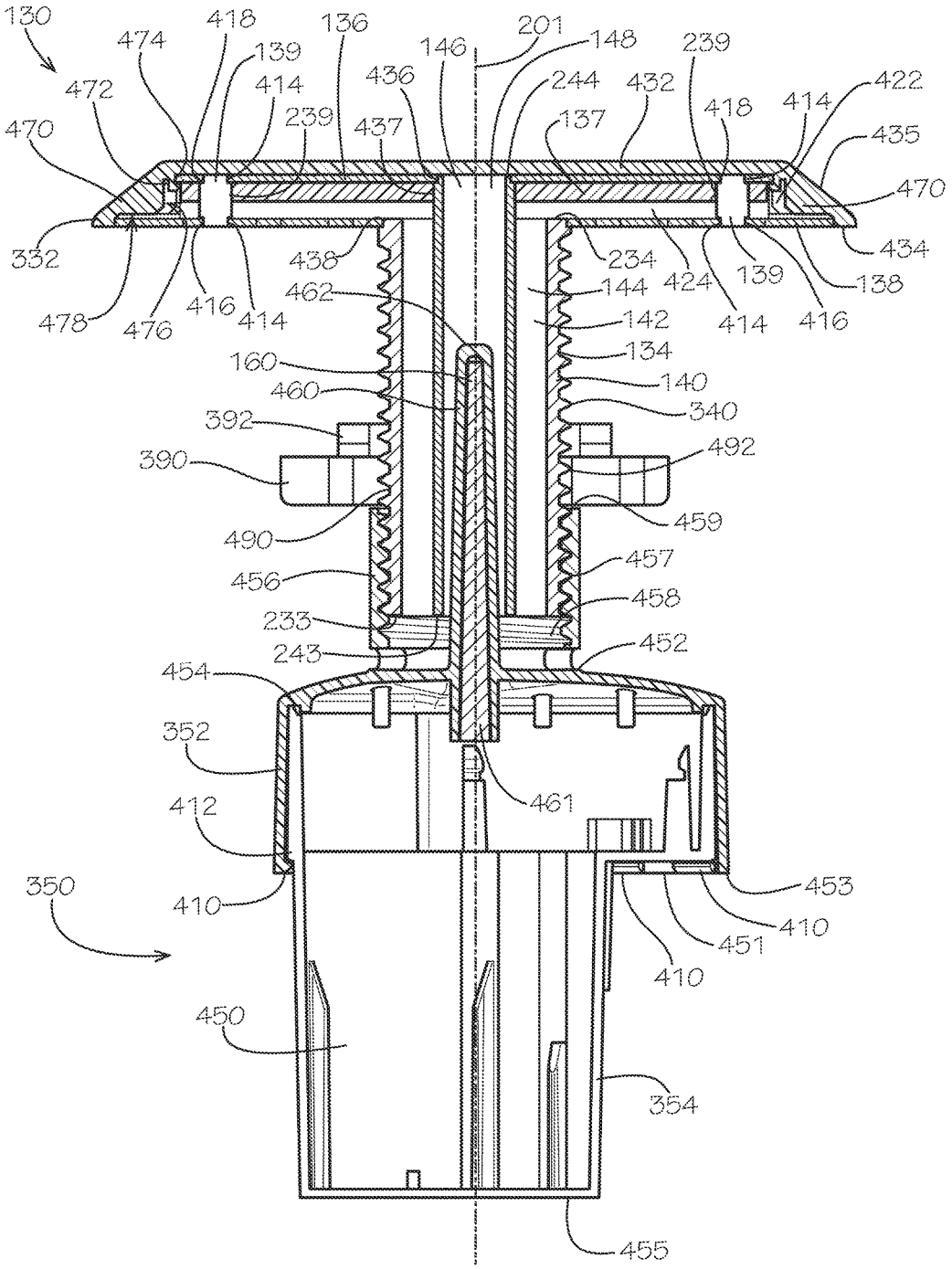
FIG. 4 is a cross-sectional view of the pit antenna and the node of FIG. 3 taken along line 4-4 shown in FIG. 3.

FIG. 4 is a cross-sectional view of the pit antenna 130 and the node 350 of FIG. 3 taken along line 4-4 shown in FIG. 3. In the present aspect of the pit antenna 130, the second inner tube end 244 can pass through a spacer bore 437 defined by the disc spacer 137 such that the disc spacer 137 can be positioned on the inner tube 146 between the first inner tube end 243 and the second inner tube end 244. The second inner tube end 244 of the inner tube 146 can be received by a top center opening 436 defined by the top disc 136 at a center of the top disc 136 to directly attach the top disc 136 to the inner tube 146. In the present aspect, the second inner tube end 244 can be sized to form an interference fit with the top center opening 436. In other aspects, the second inner tube end 244 can be attached to the top disc 136 by a method such as welding, brazing, threading, soldering, mechanically fastening or bonding, such as with an electrically conductive adhesive.

In the present aspect, the inner tube bore 148 can extend completely through the inner tube 146 from the first inner tube end 243 to the second inner tube end 244, and each of the first inner tube end 243 and the second inner tube end 244 can be open without a cover. In other aspects, the second inner tube end 244 can be fully or partially enclosed. The outer tube bore 142 can extend completely through the outer tube 140 from the first outer tube end 233 to the second outer tube end 234, and each of the first outer tube end 233 and the second outer tube end 234 can be open without a cover. In other aspects, the second outer tube end 244 can be partially enclosed.

The second outer tube end 234 of the outer tube 140 can be received by a bottom center opening 438 defined by the bottom disc 138 at a center of the bottom disc 138 to directly attach the bottom disc 138 to the outer tube 140. In the present aspect, the second outer tube end 234 can be sized to form an interference fit with the bottom center opening 438. In other aspects, the second outer tube end 234 can be attached to the bottom disc 138 by a method such as welding, brazing, threading, soldering, mechanically fastening or bonding, such as with an electrically conductive adhesive.

In the present aspect, the second outer tube end 234 of the outer tube 140 can be axially positioned between the first inner tube end 243 and the second inner tube end 244 relative to the axis 201. In the present aspect, the first inner tube end 243 can be positioned substantially flush with the first outer tube end 233. In other aspects, the first inner tube end 243 can be recessed within the outer tube bore 142 such that the first inner tube end 243 can be axially positioned between the first outer tube end 233 and the second outer tube end 234 relative to the axis 201. In other aspects, the first inner tube end 243 can extend outwards from the outer tube bore 142 such that the first outer tube end 233 can be axially positioned between the first inner tube end 243 and the second inner tube end 244 relative to the axis 201.

In the present aspect, each of the standoffs 139 can define a pair of reduced shoulders 414 disposed at opposite ends of the respective standoffs 139. The top disc 136 can define a plurality of top standoff holes 418, and the bottom disc can define a plurality of bottom standoff holes 416. For each respective standoff 139, one of the reduced shoulders 414 can be received by a one of the top standoff holes 418, and the other reduced shoulder 414 can be received by a one of the bottom standoff holes 416. Engagement between the reduced shoulders 414 and the respective standoff holes 416, 418 can attach the top disc 136, the standoffs 139, and the bottom disc 138 together, such as by an interference fit, welding, brazing, mechanical engagement such as threading, bonding with an electrically conductive adhesive, or any other suitable method.

In the present aspect, the disc spacer 137 can be positioned in facing engagement with the top disc 136, and a gap 424 can be defined between the disc spacer 137 and the bottom disc 138. In other aspects, such as the pit antenna 130 of FIG. 1, the disc spacer 137 can be positioned in facing engagement with both the top disc 136 and the bottom disc 138. In other aspects, a gap (not shown) can also be defined between the disc spacer 137 and the top disc 136.

The antenna assembly 132 of the pit antenna 130 can be received within a cover cavity 422 defined by the cover 332. In the present aspect, a top 432 of the cover 332 can be positioned adjacent to the top disc 136, and in some aspects, the top 432 of the cover 332 can be in facing engagement with the top disc 136. The bottom disc 138 can be positioned flush with a bottom 434 of the cover 332.

When the pit antenna 130 is installed through the lid opening 196 (shown in FIG. 1) of the lid 190 (shown in FIG. 1), the top disc 136, the disc spacer 137, the bottom disc 138, and the standoffs 139 can be enclosed in the cover cavity 422 between the cover 332 and the top surface 192 (shown in FIG. 1) of the lid 190. The cover 332 can protect the top disc 136, the disc spacer 137, the bottom disc 138, and the standoffs 139 from water and mechanical damage, such as when stepped on, for example and without limitation. The cover 332 can also slope axially downward and radially outward with respect to the axis 201 to provide a chamfered edge 435. The chamfered edge 435 can extend between the top 432 and the bottom 434 of the cover 332. The chamfered edge 435 can reduce the profile of the cover 332, such as to prevent impact damage from activities such as lawn maintenance.

The cover 332 can define a plurality of gussets 470 extending into the cover cavity 422 from the chamfered edge 435. The gussets 470 can strengthen the cover and can position the cover 332 over the antenna assembly 132 of the pit antenna 130. Each gusset 470 can define a bottom surface 478 which can be oriented substantially radially and perpendicular relative to the axis 201. Each gusset 470 can further define a vertical surface 476 oriented substantially parallel to the axis 201.

With the cover 332 installed on the pit antenna 130, the bottom surfaces 478 can be positioned adjacent to the bottom disc 138. In some aspects, the bottom surfaces 478 can contact the bottom disc 138 in facing engagement. The vertical surfaces 476 can maintain coaxial alignment of the cover 332 with the antenna assembly 132.

The cover 332 can further define a plurality of mounting tabs 472 disposed within the cover cavity 422 at an intersection of the top 432 and the chamfered edge 435. Each mounting tab 472 can define a mounting groove 474 configured to clip over the top disc 136 to secure the cover 332 to the antenna assembly 132.

As shown, the nut 390 can define a nut bore 490 extending through the nut 390. Internal threading 492 can be defined by the nut 390 within the nut bore 490. The internal threading 492 of the nut 390 can engage the external threading 340 of the outer tube 140 so that rotating the nut 390 relative to the outer tube 140 can translate the nut 390 along the outer tube 140 relative to the axis 201.

The node 350 can be attached to the coupling assembly 134 of the pit antenna 130. A node cavity 450 can be defined within the node 350 by the top cover 352 and the bottom cover 354. In the present aspect, the bottom cover 354 can define a top end 454 and a bottom end 455, and the top end 454 of the bottom cover 354 can be received by the top cover 352 to enclose the node cavity 450. The top cover 352 can define a top end 452 and a bottom end 453. The bottom end 453 can define a cover opening 451, and the top cover 352 can receive the bottom cover 354 through the cover opening 451. The top cover 352 can define a plurality of ledges 410 disposed at the bottom end 453 which can engage a shoulder 412 defined by the bottom cover 354 to secure the bottom cover 354 to the top cover 352.

The node 350 can enclose electrical equipment (not shown) within the node cavity 450, such as a transmitter or other electrical equipment configured to radiate, broadcast, or emit a signal over radio waves. The node antenna 160 can comprise a node antenna wire 461 disposed within a node sheath 460. In the present aspect, the node sheath 460 can be integrally defined by the top cover 352, and the node sheath 460 can extend upwards from the top end 452 of the top cover 352, substantially parallel to the axis 201. The node sheath 460 can be defined by a hollow tubular structure with an enclosed end 462, and the node antenna wire 461 can extend upwards into the node sheath 460. In some aspects, the node sheath 460 can comprises a dielectric insulation material. The node antenna wire 461 can comprise an electrically conductive material such as a metal. In the present aspect, the node antenna wire 461 of the node antenna 160 can be a quarter-wavelength monopole antenna.

The node 350 can define a node collar 456 extending upwards from the top end 452 of the top cover 352 and around the node antenna 160. The node collar 456 can define a collar bore 457 and a collar bore opening 459 of the collar bore 457. The node collar 456 can define internal threading 458 within the collar bore 457. With the first outer tube end 233 received within the collar bore 457 through the collar bore opening 459, the internal threading 458 of the node collar 456 can engage the external threading 340 of the outer tube 140 to attached the node 350 to the outer tube 140 of the coupling assembly 134 of the pit antenna 130. With the node 350 attached to the coupling assembly 134, the node antenna 160 can be received within the inner tube bore 148 of the inner tube 146 of the coupling assembly 134. Threaded attachment between the node 350 and the coupling assembly 134 can ensure that the node antenna 160 can be positioned coaxial to the inner tube bore 148 of the coupling assembly 134 and the axis 201. Coaxial alignment between the node antenna 160 and the coupling assembly 134 can ensure efficient coupling and minimize loss of signal strength between the node antenna 160 and the pit antenna 130.

Figure 5:
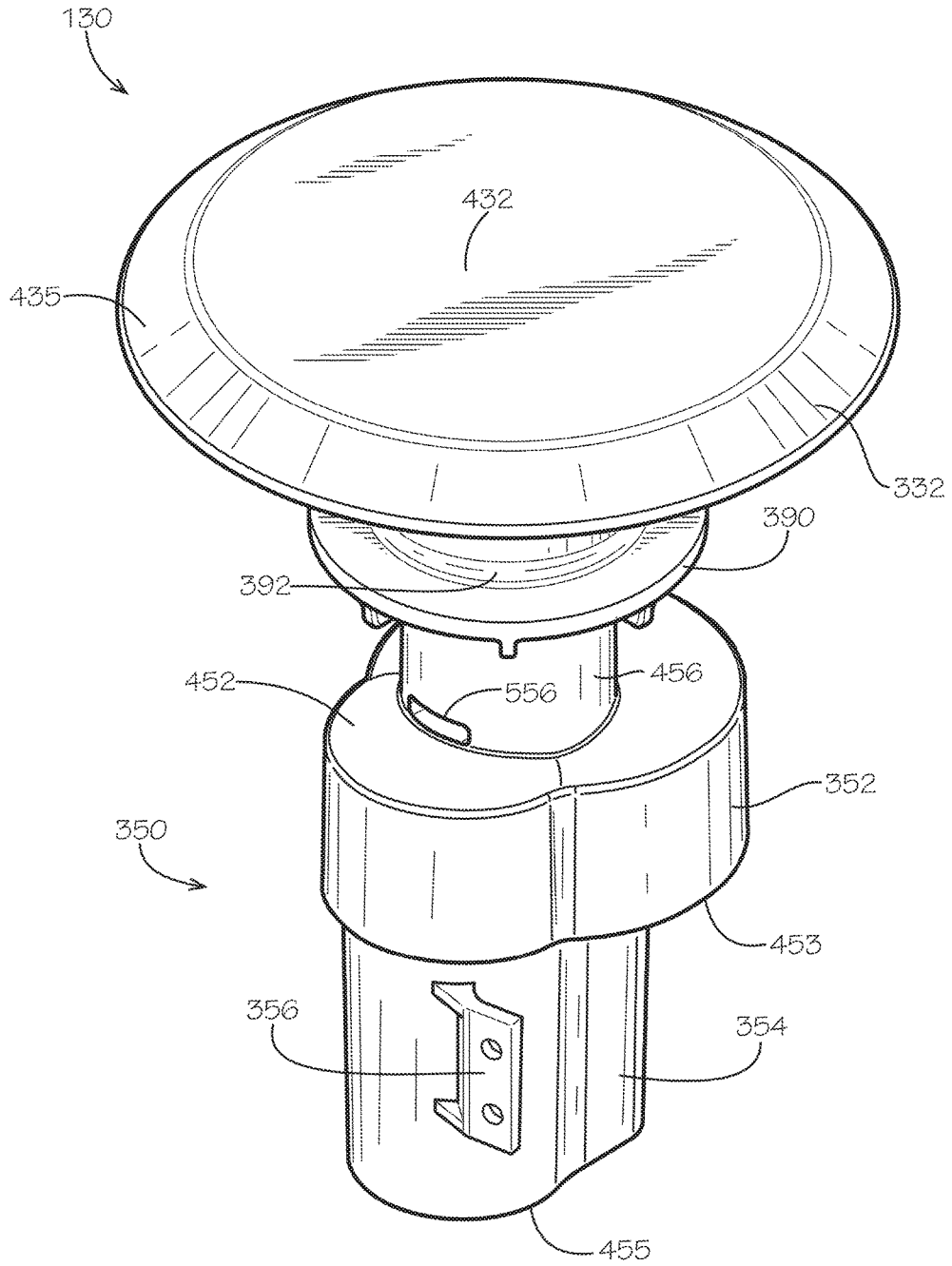
FIG. 5 is a perspective view of the pit antenna and the node of FIG. 3.

FIG. 5 is a perspective view of the pit antenna 130 and the node 350 of FIG. 3. A drain hole 556 can be defined extending through the node collar 456. The drain hole 556 can be positioned proximate to the top end 452 of the top cover 352 of the node 350. The drain hole 556 can be configured to drain fluids from the collar bore 457 (shown in FIG. 4) in order to prevent a buildup of fluids within the node collar 456.

Figure 7:
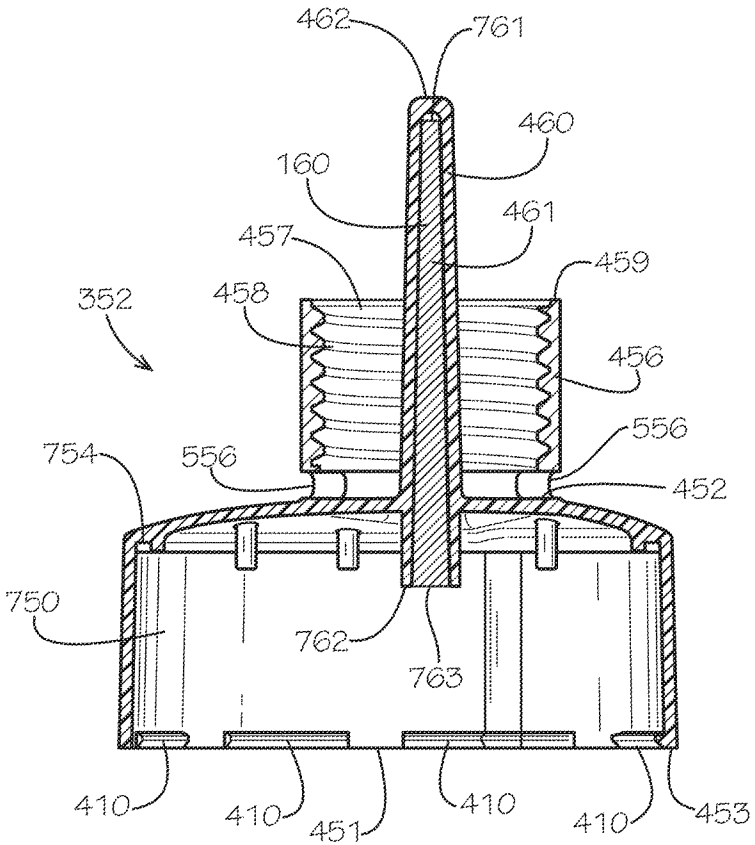
FIG. 7 is a cross-sectional view of the top cover of FIG. 6 taken along line 7-7 shown in FIG. 6.
Figure 6:
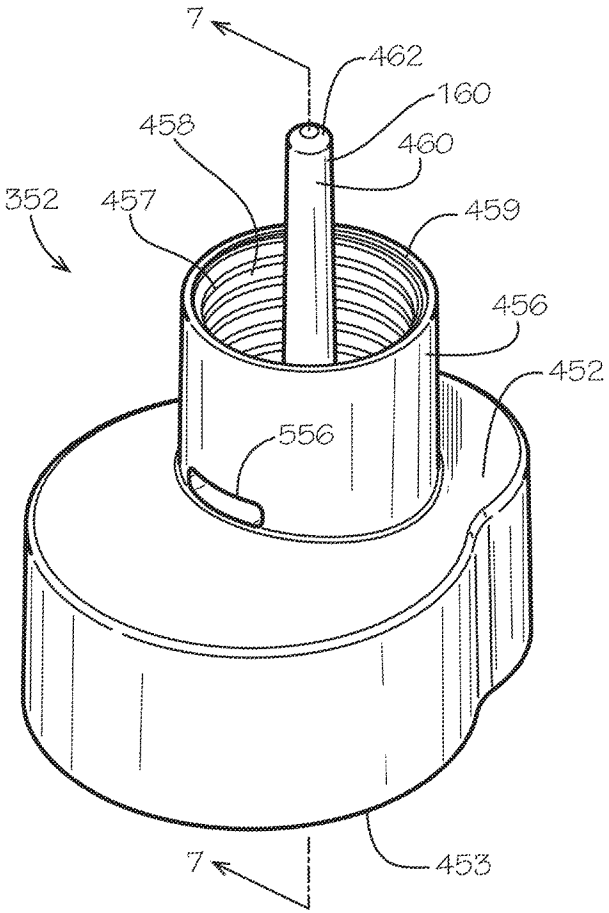
FIG. 6 is a perspective view of a top cover of the node of FIG. 3.

FIG. 6 is a perspective view of the top cover 352 of the node 350 of FIG. 3, and FIG. 7 is a cross-sectional view of the top cover 352 of the node 350 of FIG. 3 taken along line 7-7 shown in FIG. 6. The top cover 352 can define a sub-compartment 750 of the node cavity 450 (shown in FIG. 4). The sub-compartment 750 can receive the top end 454 (shown in FIG. 4) of the bottom cover 354 (shown in FIG. 3), and a groove 754 can be defined within the sub-compartment 750 which can be configured to engage the top end 454 of the bottom cover 354.

The node sheath 460 can define a sheath bore 761 extending through the node sheath 460, and the node antenna wire 461 can be disposed within the node sheath 460. The node sheath 460 can define an open end 762 disposed opposite from the enclosed end 462, and the open end 762 can define a sheath opening 763 of the sheath bore 761. The sheath opening 763 can provide access to the node antenna 160 to connect the node antenna wire 461 to electrical equipment (not shown) disposed within the node cavity 450.

Figure 8:
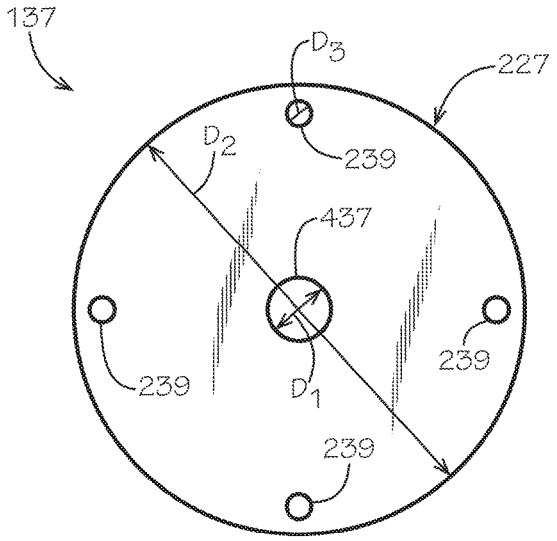
FIG. 8 is a top view of a disc spacer of the pit antenna of FIG. 3.

FIG. 8 is a top view of the disc spacer 137 of the pit antenna 130 of FIG. 3. The spacer bore 437 can define a spacer bore diameter $D_1$. In the present aspect, the spacer bore diameter $D_1$ can be equal to 0.635"±0.005". The outer spacer surface 227 of the disc spacer 137 can define an outer disc spacer diameter of $D_2$. In the present aspect, the outer disc spacer diameter of $D_2$ can be equal to 4.556"±0.005". The disc spacer 137 can define four standoff bores 239 which can be equally distributed in a circular pattern. In the present aspect, the pit antenna 130 (shown in FIG. 3) can comprise four standoffs 139 (shown in FIG. 4) equally distributed in a circular pattern around the antenna assembly 132 (shown in FIG. 3). In other aspects, the pit antenna 130 can comprise greater or fewer than four standoffs 139. Each standoff 139 can be received by a different one of the standoff bores 239. Each of the standoff bores 239 can define a standoff bore diameter $D_3$, and in the present aspect, each standoff bore diameter $D_3$ can be equal to 0.255"±0.005". In the present aspect, the disc spacer 137 can define a thickness equal to 0.138"±0.005".

Figure 9:
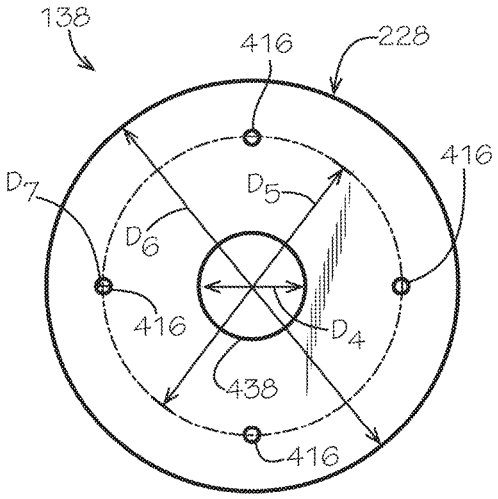
FIG. 9 is a top view of a bottom disc of the pit antenna of FIG. 3.

FIG. 9 is a top view of the bottom disc 138 of the pit antenna 130 of FIG. 3. The bottom center opening 438 can define a bottom center opening diameter $D_4$. In the present aspect, the bottom center opening diameter $D_4$ can be equal to 1.426"±0.005". The bottom standoff holes 416 can be equally spaced in a circular pattern defining a standoff pattern diameter $D_5$. In the present aspect, the standoff pattern diameter $D_5$ can be equal to 4.000"±0.005". Each of the bottom standoff holes 416 can define a bottom standoff hole diameter $D_7$ which can be equal to 0.188"±0.005" in the present aspect. The outer bottom disc surface 228 of the bottom disc 138 can define an outer bottom disc diameter $D_6$ which can be equal to 5.566"±0.005". The bottom disc 138 can define a thickness equal to 0.062"±0.005" in the present aspect.

Figure 10:
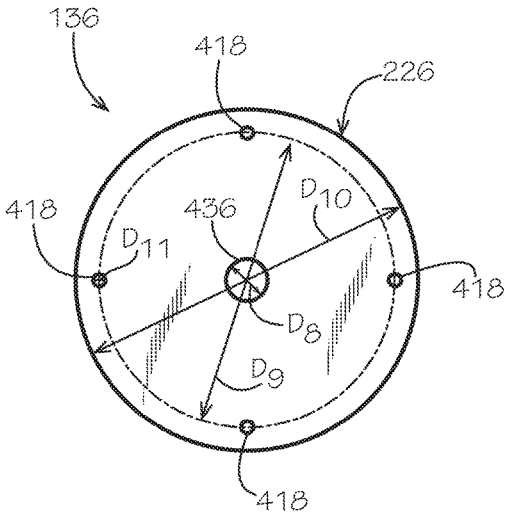
FIG. 10 is a top view of a top disc of the pit antenna of FIG. 3.

FIG. 10 is a top view of the top disc 136 of the pit antenna 130 of FIG. 3. The top center opening 436 can define a top center opening diameter $D_8$ which can be equal to 0.568"±0.005" in the present aspect. The top standoff holes 418 can be equally spaced in a circular pattern defining a standoff pattern diameter $D_9$. In the present aspect, the standoff pattern diameter $D_9$ can be equal to the standoff pattern diameter $D_5$ of the bottom disc 138 (shown in FIG. 9); however in other aspects, the standoff pattern diameter $D_9$ can be larger or smaller than the standoff pattern $D_5$. In such aspects, the standoffs 139 (shown in FIG. 4) can be angled relative to the axis 201 (shown in FIG. 4). Each of the top standoff holes 418 can define a top standoff hole diameter $D_{11}$ which can be equal to the bottom standoff hole diameter $D_7$ of the bottom standoff holes 416 (shown in FIG. 9). In other aspects, the top standoff hole diameter $D_{11}$ can be larger or smaller than the bottom standoff hole diameter $D_7$.

The outer top disc surface 226 of the top disc 136 can define an outer top disc diameter $D_{10}$ which can equal 4.628"±0.005" in the present aspect. In the present aspect, the outer top disc diameter $D_{10}$ can be larger than the outer disc spacer diameter $D_2$ (shown in FIG. 8) but smaller than the outer bottom disc diameter $D_6$ (shown in FIG. 9). In other aspects, the outer disc spacer diameter $D_2$ can be equal to or larger than the outer top disc diameter $D_{10}$. In other aspects, the outer top disc diameter $D_{10}$ can be equal to or greater than the outer bottom disc diameter $D_6$. It can be desirable in some applications for the outer bottom disc diameter $D_6$ to be larger than the outer top disc diameter $D_{10}$ so that the bottom disc 138 can act as a ground plane for the top disc 136.

As previously discussed with respect to FIG. 1, the quantity of standoffs 139 and the standoff pattern diameters $D_5$ (shown in FIG. 9) and $D_9$ can be manipulated as a method of impedance-matching the antenna assembly 132 (shown in FIG. 1) to the coupling assembly 134 (shown in FIG. 1). In some aspects, at least one slot can be cut into or through the top disc 136, as shown an further discussed below with respect to FIG. 17. In some aspects, the at least one slot can be defined within the standoff pattern diameter $D_9$ and outside of the top center opening 436. In other aspects, the at least one slot can extend outwards beyond the standoff pattern diameter $D_9$. In some aspects, the at least one slot can be spirally shaped, such as wrapping around the top center opening 436, for example and without limitation. The at least one slot can provide an inductive load for current flowing through the top disc 136. In such aspects, the outer top disc diameter $D_{10}$ can be reduced significantly smaller than 4.628" while maintaining the impedance match between the antenna assembly 132 (shown in FIG. 1) and the coupling assembly 134 (shown in FIG. 1).

Figure 11:
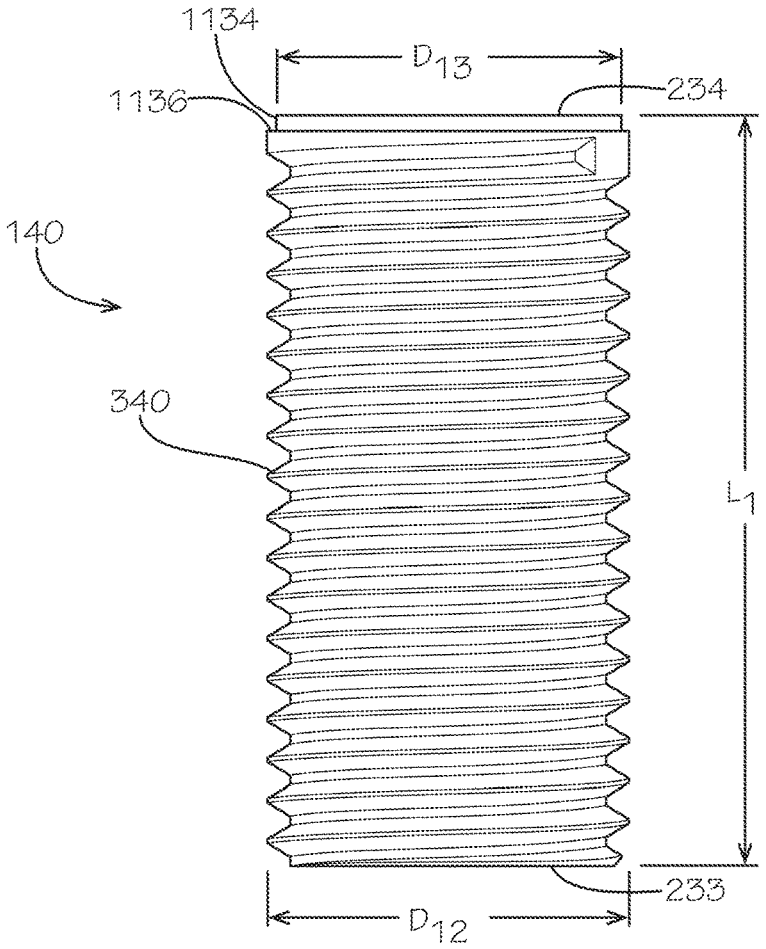
FIG. 11 is a side view of an outer tube of the pit antenna of FIG. 3.

FIG. 11 is a side view of the outer tube 140 of the pit antenna 130 of FIG. 3. A reduced outer neck 1134 and a neck shoulder 1136 can be defined at the second outer tube end 234 of the outer tube 140. The external threading 340 can substantially extend from the neck shoulder 1136 to the first outer tube end 233. The reduced outer neck 1134 can define a reduced outer neck diameter $D_{13}$ which can be sized to closely fit within the bottom center opening 438 (shown in FIG. 9) of the bottom disc 138 (shown in FIG. 9). With the reduced outer neck 1134 received within the bottom center opening 438, the neck shoulder 1136 can be positioned adjacent to the bottom disc 138 in facing engagement. In some aspects, the bottom center opening 438 and the reduced outer neck 1134 can define complimentary threading, and the bottom disc 138 can be mechanically engaged with the outer tube 140.

The outer tube 140 can define an outer diameter $D_{12}$. In the present aspect, the outer diameter $D_{12}$ can be defined by a basic major threading diameter of the external threading 340. In the present aspect, the external threading 340 can be 1½"-6 Unified National Course ("UNC") threads, and the outer diameter $D_{12}$ can equal to 1.5". In other aspects, the external threading 340 can be a different size of threading or can be fine rather than course threading, such as Unified National Fine threads, and the outer diameter $D_{12}$ can be larger or smaller than 1.5". The outer tube 140 can define an outer tube length $L_1$ extending from the first outer tube end 233 to the second outer tube end 234. In the present aspect, the outer tube length $L_1$ can equal 3.075"±0.005".

Figure 12:
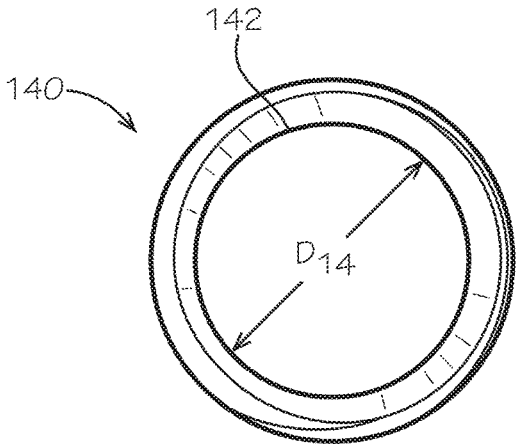
FIG. 12 is an end view of the outer tube of FIG. 11.

FIG. 12 is an end view of the outer tube 140 of the pit antenna 130 of FIG. 3. The outer tube bore 142 can define an outer tube bore diameter $D_{14}$. In the present aspect, the outer tube bore diameter $D_{14}$ can equal 1.120"±0.005". In some aspects, the outer tube 140 can be partially or fully coated with a dielectric insulation material. In some aspects, the outer tube bore 142 can be partially or fully lined with a dielectric insulation material.

Figure 13:
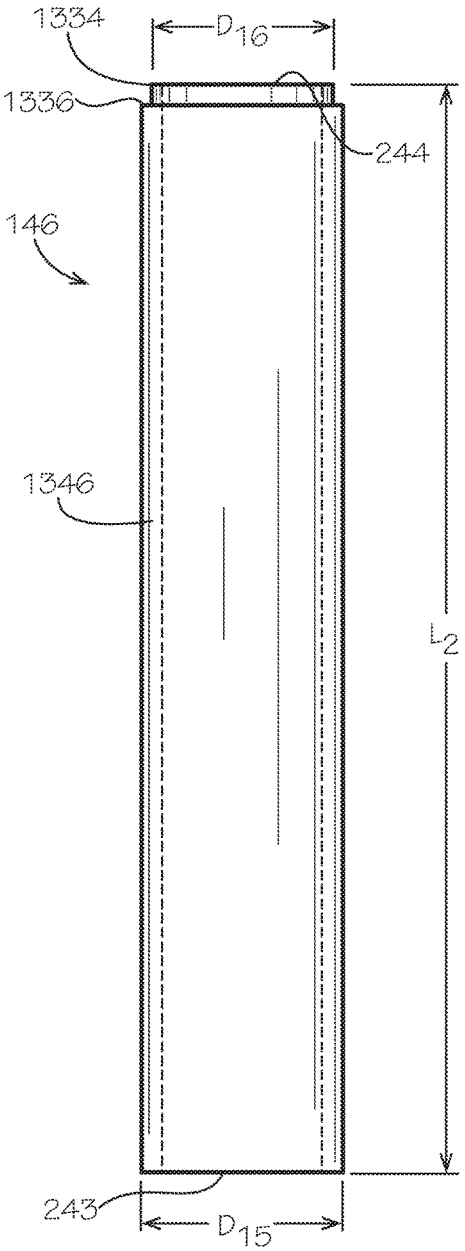
FIG. 13 is a side view of an inner tube of the pit antenna of FIG. 3.

FIG. 13 is a side view of the inner tube 146 of the pit antenna 130 of FIG. 3. The inner tube 146 can define a reduced inner neck 1334 and a body portion 1346. A neck shoulder 1336 can be defined between the reduced inner neck 1334 and the body portion 1346. The reduced inner neck 1334 can be defined at the second inner tube end 244, and the body portion 1346 can extend from the neck shoulder 1336 to the first inner tube end 243. The reduced inner neck 1334 can define a reduced inner neck diameter $D_{16}$ which can be smaller than a body portion diameter $D_{15}$ defined by the body portion 1346 of the inner tube 146. In the present aspect, the body portion diameter $D_{15}$ can be equal to 0.630"±0.005". The inner tube 146 can define a inner tube length $L_2$ extending from the first inner tube end 243 to the second inner tube end 244.

In the present aspect, the reduced inner neck 1334 and the body portion 1346 can be integrally formed, such as by casting, forging, or machining the inner tube 146 from stock. In other aspects, the body portion 1346 can be defined by an outer sleeve, and the reduced inner neck 1334 can be defined by an inner sleeve extending through the outer sleeve from the first inner tube end 243 to the second inner tube end 244. In some aspects, the outer sleeve can comprise a dielectric insulation material, and the inner sleeve can comprise an electrically conductive material such as copper, brass, aluminum, steel, or any other suitable material.

The reduced inner neck diameter $D_{16}$ can be sized to closely fit within the top center opening 436 (shown in FIG. 10) of the top disc 136 (shown in FIG. 10). With the reduced inner neck 1334 received within the top center opening 436, the neck shoulder 1336 can be positioned adjacent to the top disc 136 in facing engagement. In some aspects, the reduced inner neck 1334 and the top center opening 436 can defined complimentary threading, and the top disc 136 can be mechanically engaged to the inner tube 146.

Figure 14:
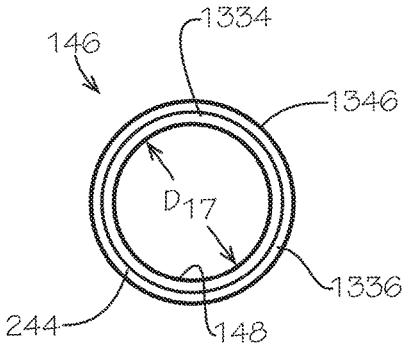
FIG. 14 is an end view of the inner tube of FIG. 13.

FIG. 14 is an end view of the inner tube 146 of the pit antenna 130 of FIG. 3. The inner tube bore 148 can define an inner tube bore diameter $D_{17}$. In the present aspect, the inner tube bore diameter $D_{17}$ can equal 0.495"±0.005". In some aspects, the inner tube 140 can be partially or fully coated with a dielectric insulation material. In some aspects, the inner tube bore 148 can be partially or fully lined with a dielectric insulation material.

Figure 15:
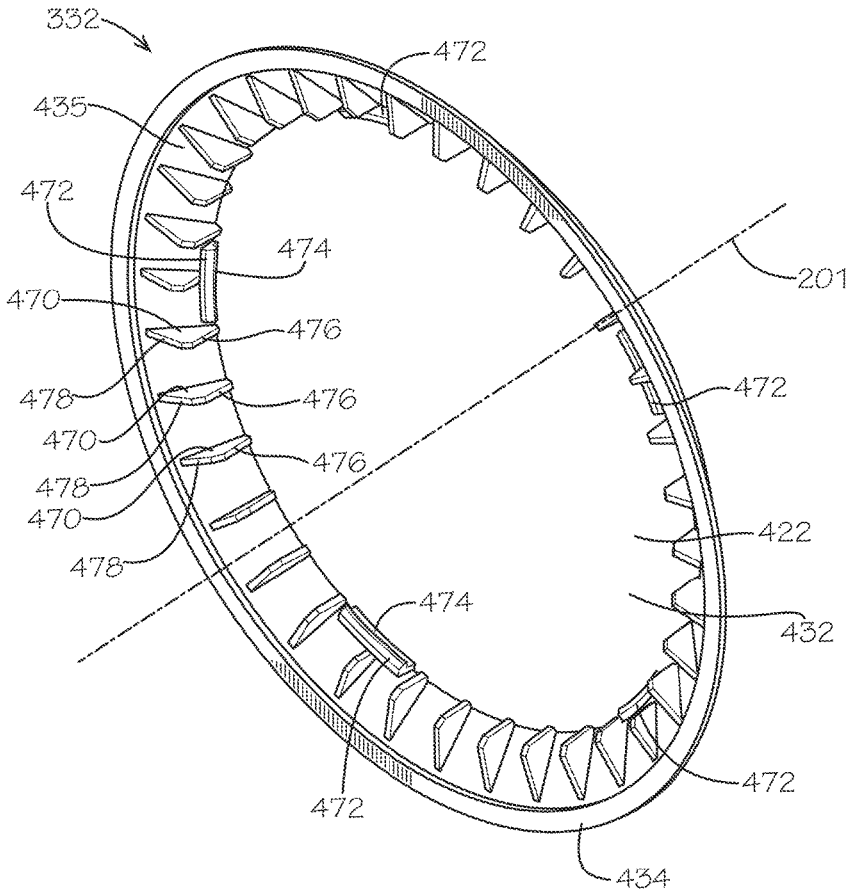
FIG. 15 is a perspective view of a cover of the pit antenna of FIG. 3.

FIG. 15 is a perspective view of the cover 332 of the pit antenna 130 of FIG. 3. As shown, the plurality of gussets 470 can be equally circumferentially distributed around the chamfered edge 435, and the gussets 470 can extend inwards into the cover cavity 422. The mounting tabs 472 can also be equally circumferentially distributed within the cover cavity 422 around an intersection of the top 432 and the chamfered edge 435.

Figure 16:
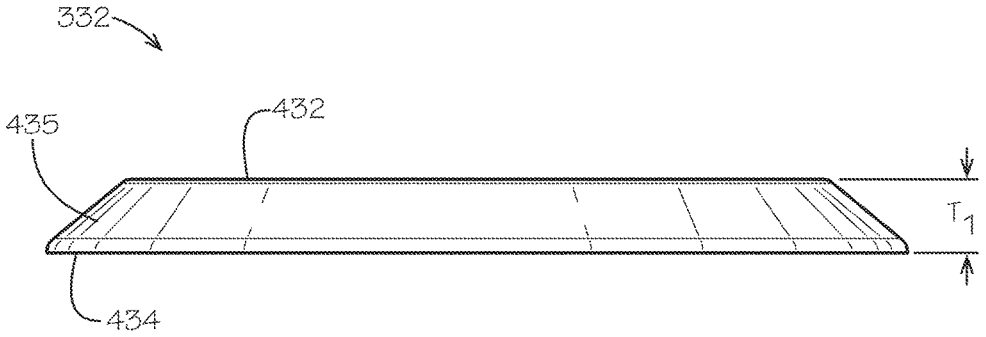
FIG. 16 is a side view of the cover of FIG. 15.

FIG. 16 is a side view of the cover 332 of the pit antenna 130 of FIG. 3. The cover 332 can define a cover thickness $T_1$ between the top 432 and the bottom 434 of the cover 332. In the present aspect, the cover thickness $T_1$ can be between 0.480" and 0.500".

The recited dimensional values are merely exemplary of one aspect of the pit antenna 130 and should not be viewed as limiting. Each dimensional value can be larger or smaller than the recited value in other aspects of the pit antenna 130. The size and shape of the pit antenna 130 can be impacted by the intended transmission frequency of the pit antenna 130. The physical size of components of the pit antenna 130 can affect resonance of the pit antenna 130. In the present aspect, the pit antenna 130 of FIG. 3 can be configured to couple and transmit radio waves in the ISM radio band of 902-928 MHz. In other aspects, the pit antenna 130 can be configured to couple and transmit radio waves in a different radio band, and the shape and the size of the pit antenna 130 can be different for the aspect of the pit antenna 130 of FIG. 3.

Figure 17:
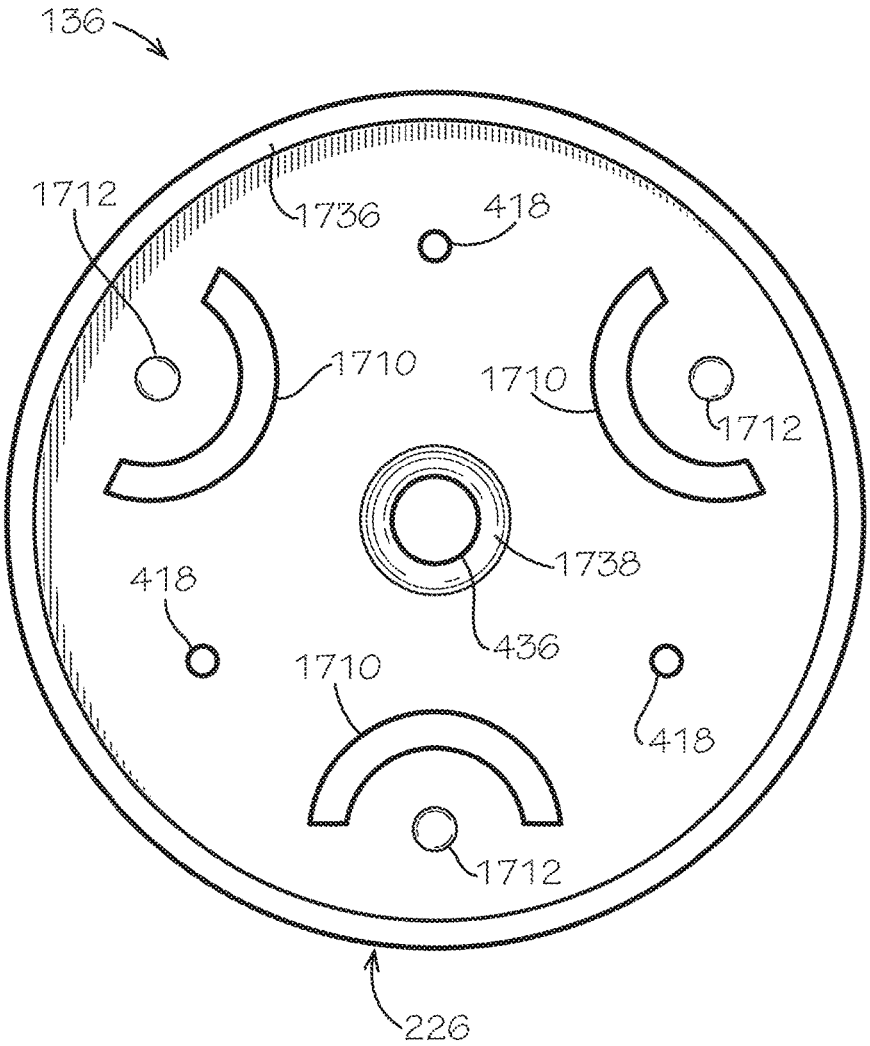
FIG. 17 is a top view of another aspect of the top disc of the pit antenna in accordance with another aspect of the present disclosure.

FIG. 17 is a top view of another aspect of the top disc 136 in accordance with another aspect of the present disclosure. In the aspect, shown, the top disc 136 can comprise three top standoff holes 418 which can correspond to three standoffs 139 (shown in FIG. 1). As previously discussed, the number and spacing of top standoff holes 418 and standoffs 139 can be manipulated to alter the inductance value of the top disc 136. In the present aspect, the top disc 136 can also define a plurality of dimples 1712 which can extend into, but not through, the top disc 136. In the present aspect, the top disc 136 can also define a plurality of slots 1710 extending through the top disc 136.

In the present aspect, the slots 1710 can be defined between the dimples 1712 and the top center opening 436. In other aspects, the slots 1710 can be defined between the top standoff holes 418 and the top center opening 436. In other aspects, the slots 1710 can be defined extending at least partially radially outward beyond the dimples 1712 or the top center openings 436. In still other aspect, the slots 1710 can be distributed without any particular spatial relationship to the top standoff holes 418 or the dimples 1712. In the present aspect, each of the slots 1710 can be semicircular, and the slots 1710 can be centered around the respective dimples 1712. In other aspects, the slots 1710 can define different shapes, such as liner slots, spiral slots, or polygonal slots, such as triangular, rectangular, pentagonal, or any other suitable shape. In other aspects, the top disc 136 can define a plurality of patterned holes (not shown) in place of or in addition to the plurality of slots 1710. The slots 1710, dimples 1712, and patterned holes (not shown) can be distributed on the top disc 136 in order to increase or decrease inductance of the top disc 136.

In the present aspect, the top disc 136 can define an outer chamfered edge 1736 which can intersect the outer top disc surface 226. In the present aspect, the top disc 136 can also define an inner chamfered edge 1738 extending radially outward from the top center opening 436. In other aspects, either or both of the chamfered edges 1736,1738 can be a beveled, rounded, or squared edge.

Additionally, the pit antenna 130 of FIG. 3 can be sized and shape to be compatible with standard industry lids 190 (shown in FIG. 1) and pit vaults 110 (shown in FIG. 1). Some compromises to performance and total transmission efficiency can be made to adapt the pit antenna 130 to the dimensions of the lids 190 and the pit vaults 110 commonly used. For example and without limitation, computer modeling indicates that the total transmission efficiency can be improved by approximately 2 dB in the 902-928 MHz ISM radio band by increasing the lid opening 196 from 1.75" to 2" in diameter and increasing an outer diameter $D_{12}$ (shown in FIG. 11) of the outer tube 140 (shown in FIG. 3) and the body portion diameter $D_{15}$ (shown in FIG. 13) of the inner tube 146 accordingly. However, such a modification would require replacement or modification of existing lids 190 defining 1.75" diameter lid openings 196 which would increase costs for retrofitting existing pit assemblies 100. Additionally, a depth of the pit vaults 110 can limit the outer tube length $L_1$ (shown in FIG. 11) and the inner tube length $L_2$ (shown in FIG. 13).

Where dimensional compromise can be required by standard dimensions of the lid 190 and the pit vaults 110, dielectric insulation materials can be utilized to tune the pit antenna 130 to achieve resonance at the desired frequency range. In the present aspect, the dielectric insulation materials can define a relative permittivity value greater than 1.0, and preferably between 2.0 and 4.0. For example and without limitations, in some aspects, the dielectric insulation materials can comprise unfilled high density polyethylene (HDPE) which can define a relative permittivity of 2.2, or acrylonitrile butadiene styrene (ABS) which can define a relative permittivity of 2.5. In other aspects, the relative permittivity value of the dielectric insulation materials can be higher, such as from 6.0 to greater than 8.0, for example and without limitation. Other examples of dielectric insulation materials can comprise a plastic material, such a polytetrafluoroethylene, polyethylene, polyimide, polypropylene, or any other suitable plastic material. In other aspects, some dielectric insulation material may not be a plastic. For example, some dielectric insulation materials can comprise mica, silicon dioxide, graphite, rubber, or any other suitable material. In some aspects, the pit antenna 130 can comprise multiple different dielectric insulation materials.

Dielectric insulation materials can tune components to a desired "electrical length" where the physical dimensions, such as the physical length or physical diameter of a component, cannot equal the electrical length required to achieve resonance. For example, a ¼ wavelength monopole antenna can define a physical length of ¼ wavelength of a radio wave at a desired transmission frequency, such as approximately 3.27" for a ¼ wavelength of a radio wave with a frequency of 902 MHz. However, the physical length of the monopole antenna can be reduced by coating, covering, or enclosing the antenna with a dielectric insulation material so that the ¼ wavelength electrical length can be maintained in a more compact antenna.

The physical length, or diameter in the case of a disc antenna, can be approximately reduced by a factor equal to the square root of the relative permittivity of the dielectric insulation material. For example and without limitation, the disc spacer 137 of FIG. 1 comprising a dielectric insulation material with a relative permittivity of 4.0 can reduce the outer top disc diameter $D_{10}$ (shown in FIG. 10) of the top disc 136 of FIG. 1 by a factor of 2.0 while maintaining the same electrical length of the top disc 136. The inclusion of dielectric insulation materials can therefore provide for a more compact pit antenna 130 or allow the pit antenna 130 to be tuned for applications with a limited space envelope. The outer top disc diameter $D_{10}$ (shown in FIG. 10) of the top disc 136 of FIG. 1 can further be reduced by forming the disc spacer 137 from a dielectric insulation material with a relative permittivity from 6.0 to greater than 8.0. For example and without limitation, by utilizing a dielectric insulation material defining a relative permittivity of 9.0, the outer top disc diameter $D_{10}$ could be reduced by a factor of 3.0 while maintaining the same radio frequencies of operation compared to an aspect of the disc spacer 137 defining a relative permittivity of 1.0.

Additionally, by manipulating the size of the antenna assembly 132 (shown in FIG. 3) and utilizing dielectric insulation materials, an impedance of the antenna assembly 132 can be matched to an impedance of the coupling assembly 134 (shown in FIG. 3) to achieve resonance between the coupling assembly 134 and the antenna assembly 132, despite dimensional limitations placed upon the coupling assembly 134 by the standard lids 190 (shown in FIG. 1) and pit vaults 110 (shown in FIG. 1).

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A pit antenna assembly comprising:

a node, the node comprising an antenna, the antenna configured to radiate radio waves;

an inner tube defining a first inner tube end and a second inner tube end, the first inner tube end disposed opposite from the second inner tube end, the inner tube defining an inner tube bore extending through the inner tube from the first inner tube end to the second inner tube end, the antenna received within the inner tube bore through the first inner tube end, the inner tube configured to electromagnetically couple energy from the antenna; and a top disc, the top disc connected to the second inner tube end of the inner tube, the top disc configured to radiate the energy from the antenna.

2. The pit antenna assembly of claim 1, wherein:

the top disc defines a top center opening;

the second inner tube end of the inner tube is received by the top center opening of the top disc; and a longitudinal axis of the inner tube is substantially perpendicular to the top disc.

3. The pit antenna assembly of claim 1, further comprising a bottom disc defining a bottom center opening, the inner tube extending through the bottom center opening, the bottom disc attached to the top disc by a standoff, the top disc, the standoff, and the bottom disc connected in electrical communication, the bottom disc configured to radiate the energy from the antenna.

4. The pit antenna assembly of claim 3, further comprising a disc spacer positioned between the top disc and the bottom disc, the disc spacer comprising a dielectric insulation material.

5. The pit antenna assembly of claim 3, further comprising an outer tube defining a first outer tube end and a second outer tube end, the first outer tube end disposed opposite from the second outer tube end, the outer tube defining an outer tube bore extending through the outer tube from the first outer tube end to the second outer tube end, the second outer tube end connected to the bottom disc, the inner tube positioned in the outer tube bore.

6. The pit antenna assembly of claim 1, wherein:

the inner tube defines an inner surface and an outer surface;

the inner surface defines the inner tube bore; and at least a portion of the outer surface is covered with a dielectric insulation material.

7. The pit antenna assembly of claim 1, wherein the inner tube is electrically isolated from the antenna.

8. The pit antenna assembly of claim 1, wherein the top disc defines a slot extending through the top disc.

9. A pit assembly comprising:

a pit vault defining a top end and a bottom end, a vault cavity defined within the pit vault, a vault opening of the vault cavity defined at the top end;

a lid shaped and sized complimentary to the vault opening, the lid defining a top surface and a bottom surface, a lid opening defined extending through the lid from the top surface to the bottom surface, the lid covering the vault opening and at least partially enclosing the vault cavity; and a pit antenna comprising:

an antenna assembly defining a disc shape and positioned atop the top surface of the lid; and a coupling assembly attached to the antenna assembly, the coupling assembly defining a tubular shape, the coupling assembly extending downwards from the antenna assembly, the coupling assembly extending through the lid opening and into the vault cavity, the coupling assembly defining an inner tube bore configured to receive an antenna.

10. The pit assembly of claim 9, wherein:

the antenna assembly comprises a top disc, a bottom disc, and a disc spacer;

the disc spacer is positioned between the top disc and the bottom disc; and the bottom disc is positioned adjacent to the top surface of the lid.

11. The pit assembly of claim 10, wherein:

the coupling assembly comprises an inner tube and an outer tube;

the outer tube is attached to the bottom disc;

the inner tube extends through the outer tube, the bottom disc, and the disc spacer and is attached to the top disc; and the inner tube defines the inner tube bore.

12. The pit assembly of claim 10, wherein:

the pit antenna further comprises a cover;

the cover defines a cover cavity; and the top disc, the disc spacer, and the bottom disc are enclosed in the cover cavity by the cover and the top surface of the lid.

13. The pit assembly of claim 10, wherein:

the antenna assembly further comprises a plurality of standoffs attaching the top disc to the bottom disc;

the plurality of standoffs are arranged in a circular distribution; and the top disc, the bottom disc, and the standoffs are connected in electrical communication.

14. The pit assembly of claim 9, wherein the pit antenna further comprises a nut, the nut defining a nut bore and internal threading disposed within the nut bore, the coupling assembly extending through the nut bore, the internal threading engaging external threading defined by the coupling assembly, the lid secured on the pit antenna between the antenna assembly and the nut.

15. The pit assembly of claim 9, further comprising a node disposed within the vault cavity, the node comprising a node antenna received within the inner tube bore, the node antenna electrically isolated from the pit antenna, the node antenna configured to radiate radio frequency energy, the coupling assembly configured to receive the radio frequency energy within the vault cavity, and the antenna assembly configured to radiate the radio frequency energy outside of the vault cavity as radio waves.

16. A method of coupling a pit antenna to a node, the method comprising:

inserting a node antenna of the node into an inner tube bore of the pit antenna, a coupling assembly of the pit antenna comprising an inner tube, the inner tube bore defined by the inner tube, the node and the coupling assembly positioned within a vault cavity defined by a pit vault;

passively receiving radio-frequency energy from the node antenna with the coupling assembly of the pit antenna; and passively radiating the radio-frequency energy as radio waves outside of the pit vault from an antenna assembly of the pit antenna, the radio waves carrying a signal, the antenna assembly electrically connected to the coupling assembly, the antenna assembly disposed external to the pit vault.

17. The method of claim 16, wherein the node antenna is electrically isolated from the pit antenna.

18. The method of claim 16, further comprising attaching the pit antenna to a lid configured to at least partially enclose the pit vault.

19. The method of claim 18, further comprising inserting the coupling assembly through a lid opening defined by the lid.

20. The method of claim 16, further comprising attaching the node to the coupling assembly of the pit antenna.

21. The method of claim 16, further comprising transmitting data from a water meter through the signal.

* * * * *